United States Patent [19]

Young

[11] 4,312,530

[45] Jan. 26, 1982

[54] CHOPSTICKS ASSEMBLY

[76] Inventor: Nien-Tzu Young, 2000 E. Delores St., West Covina, Calif. 91792

[21] Appl. No.: 155,062

[22] Filed: Jun. 2, 1980

[51] Int. Cl.[3] ..... A47G 21/10

[52] U.S. Cl. ..... 294/16; 294/118

[58] Field of Search ..... 294/3, 8.5, 11, 16, 294/28, 29, 31 R, 33, 99 R, 99 S, 118

[56] References Cited

U.S. PATENT DOCUMENTS

| | | | |
|---|---|---|---|
| 63,083 | 3/1867 | Ott | 294/118 X |
| 602,097 | 4/1898 | Oertle | 294/118 |
| 655,463 | 8/1900 | Smythe | 294/118 |
| 1,742,232 | 1/1930 | Casale | 294/118 |
| 2,392,118 | 1/1946 | Cacarillo | 294/118 X |
| 2,668,538 | 2/1954 | Baker | 294/118 X |
| 3,239,262 | 3/1966 | Rines et al. | 294/16 |
| 3,323,825 | 6/1967 | Arima | 294/16 |

*Primary Examiner*—Johnny D. Cherry
*Attorney, Agent, or Firm*—William W. Haefliger

[57] ABSTRACT

A chopsticks assembly includes pivoted chopsticks, spring urged to spread apart position, and otherwise retainable in nested collapsed position.

1 Claim, 9 Drawing Figures

CHOPSTICKS ASSEMBLY

BACKGROUND OF THE INVENTION

This invention relates generally to chopsticks, and more particularly concerns improvements in the construction of same.

Chopsticks can be very difficult to use by the untrained diner, as is well known. There is a need for improvements in such implements as will enable even the untrained user to easily manipulate same.

SUMMARY OF THE INVENTION

It is a major object to provide an unusually advantageous construction of chopsticks, to meet the above need. The present invention provides a simple, inexpensive design or construction of an assembly that includes:

(a) a pair of elongated chopsticks, (b) pivot means interconnecting the chopsticks to allow scissors pivoting thereof in generally the same plane, and about a pivot axis, (c) a spring biasing the chopsticks to a spread apart position and allowing finger pivoting thereof toward a closed position, and (d) retention means to releasably retain the chopsticks in said closed position.

As will appear, the retention means is so located as to release when the lower ends of the chopsticks are impacted against a table surface; the chopsticks have handles that extend in laterally overlapping relation so as to enable relative sliding of adjacent inner surfaces that are recessed to contain torsion spring arms; and the chopsticks interfit in closed position with the handles extending in face to face relation in a first direction parallel to the pivot axis, and with the tongs extending in face to face relation in a second direction normal to said first direction.

These and other objects and advantages of the invention, as well as the details of an illustrative embodiment, will be more fully understood from the following description and drawings, in which:

DRAWING DESCRIPTION

Figure 2:
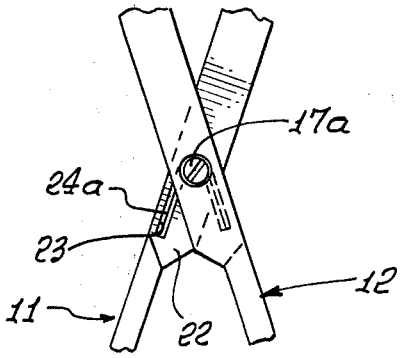
FIG. 2 is a fragmentary rear elevation of a portion of the FIG. 1 chopsticks assembly.
Figure 2A:
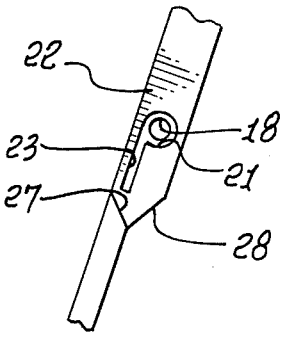
Figure 3:
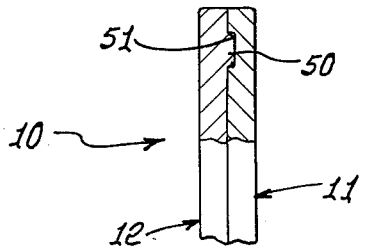
Figure 4:
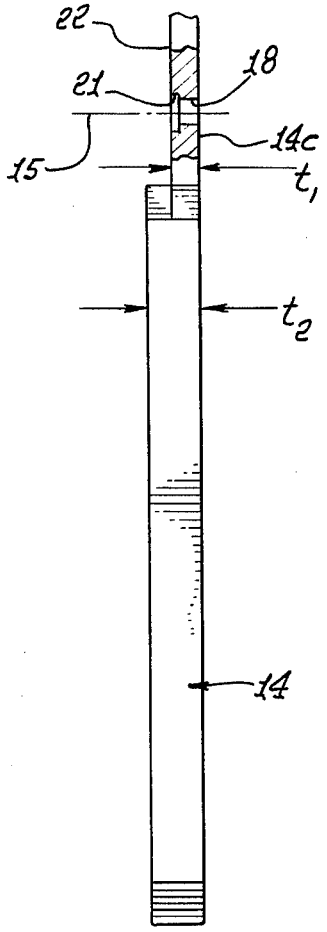
Figure 5:
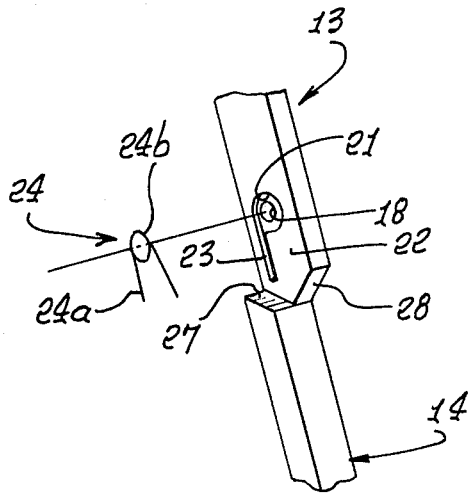
Figure 6:
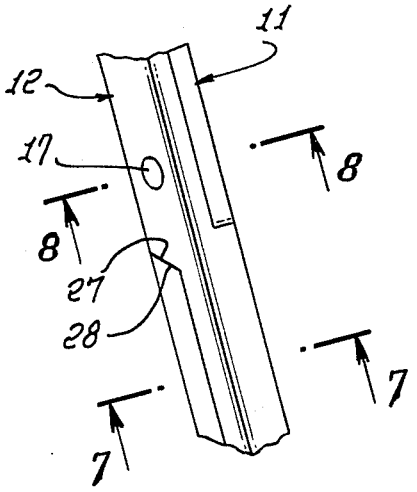

FIG. 2*a* is a fragmentary view of the inner side of a stick, near the pivot axis;

FIG. 3 is a side elevation showing the top portions of the chopsticks, interconnected by lateral means;

FIG. 4 is a side elevation of the intermediate and lower portions of one chopstick;

FIG. 5 is a perspective view of the intermediate portion of the one FIG. 4 chopstick;

FIG. 6 is a fragmentary view of the chopsticks in collapsed position; and

Figure 7:
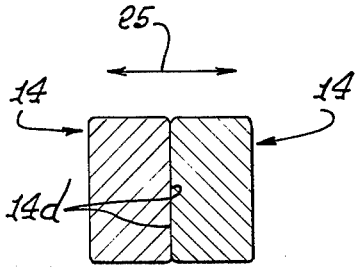
Figure 8:
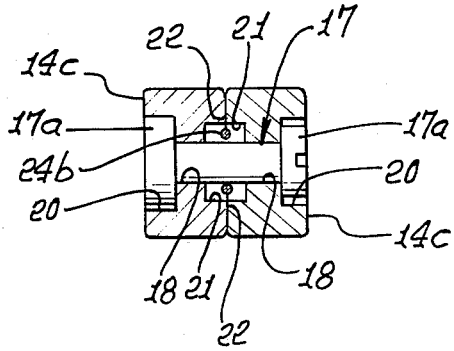

FIGS. 7 and 8 are enlarged sections taken on lines 7—7 and 8—8, respectively, in FIG. 6.

DETAILED DESCRIPTION

Figure 1:
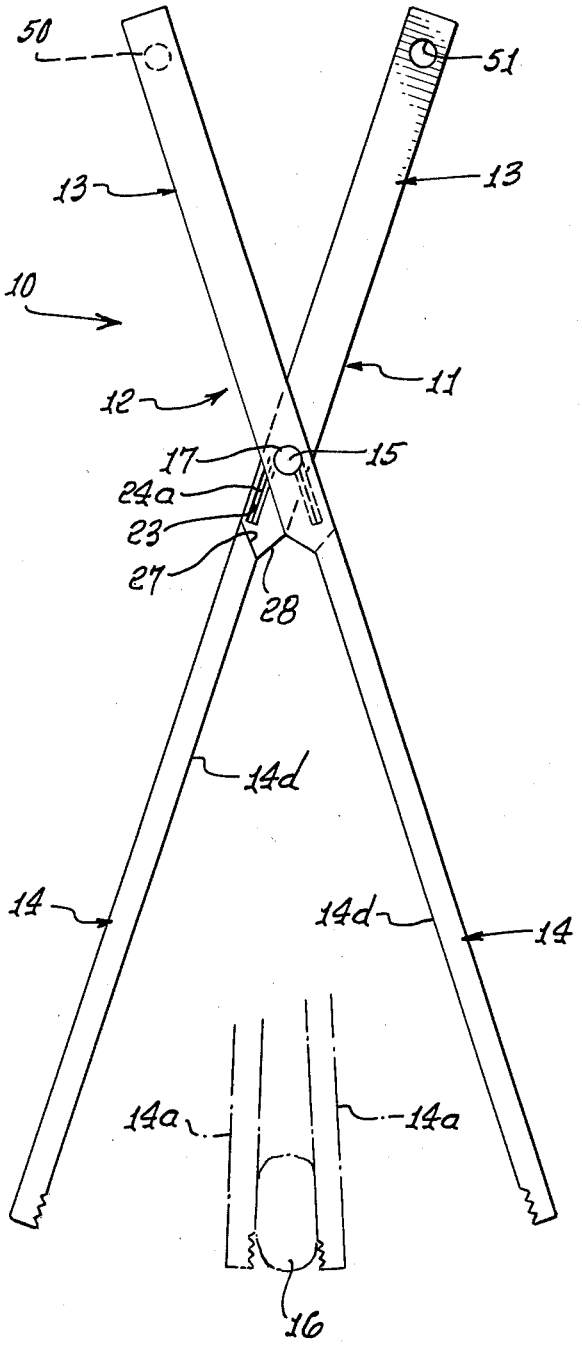
FIG. 1 is a frontal elevation showing the chopsticks in assembled, spread apart position.

In the drawings, the assembly 10 includes two like chopsticks 11 and 12, which are longitudinally elongated. Each chopstick, which may consist of plastic, wood, or other material, includes a handle portion 13, and a tong portion 14, respectively at opposite longitudinal sides of a common pivot axis 15, the lengths of the tong portions typically exceeding the lengths of the handle portions. Pivot means interconnects the two chopsticks to allow scissors pivoting thereof between extended "spring relaxed" position, as seen in FIGS. 1 and 2, and closed or collapsed "spring tensioned" position, as seen in FIGS. 3 and 6–8. In this regard, a spring biases the two chopsticks to the spread apart position in FIG. 1, and allows ready finger pivoting of the chopsticks lightly forcibly toward closed position. See for example the broken line position 14*a* of the tongs, in FIG. 1, with a morsal of edible therebetween at 16.

More specifically, a fastener 17 extends through bores 18 defined by the handle portion 14, the heads 17*a* of the fastener being flush with the outer surfaces 14*c* of the sticks, as is seen in FIG. 8. Such heads are located in counterbores 20, seen in FIG. 8. Counterbore recesses 21 are also sunk in the inner overlapping faces 22 of the two sticks, and are intersected by narrow longitudinal recesses 23. The latter receive the arms 24*a* of a torsion spring 24, the spring having a turned portion 24*b* partially received in each of the recesses 21, which are in registration. The construction is such that the torsion spring arms 24*a* in the recess 23 act to bias the chopsticks toward FIG. 1 position, and also do not interfere with close overlap of the handle portions, at closely facing flat inner surfaces 22.

It will be noted that the tongs define a common plane as they pivot toward and away from one another in directions indicated by arrows 25 in FIG. 7. When the assembly is in closed position, as seen in FIG. 6, the tongs extend side by side, with their inner faces 14*d* directly facing one another. Those faces move perpendicularly toward and away from one another as the tongs are pivoted. As distinct from this, the inner faces 22 of the handle portions move parallel to one another as the tongs are pivoted. In this regard, note the approximately square overall cross sections in FIGS. 7 and 8; also, note in FIG. 4 that the thickness "$t_1$" of the handle portion, in the direction of axis 15, is about half the overall thickness $t_2$ of the tong portion, in that direction. Tapered shoulders 27 and 28 are defined by the tong portion and handle portion, at their juncture, and they extend in an offset V-configuration, in FIG. 1 (see FIG. 5, showing the offset).

Also provided is retention means to releasably retain the chopsticks in closed position. As appears in FIGS. 1 and 3, the retention means may advantageously comprise interengageable shoulders on the two sticks, and spaced near the ends of the handles, so as to unsnap or release in response to impact jarring of the closed tong ends on the table surface. Note the protrusion 50 on one stick handle that releasably interfits shallow recess 51 in the inner face of the other stick handle.

I claim:

1. In a chopsticks assembly, (a) a pair of elongated chopsticks, (b) pivot means interconnecting the chopsticks to allow scissors pivoting thereof in generally the same plane, and about a pivot axis, the chopsticks each including a handle at one longitudinal side of the pivot means, and a tong at the opposite longitudinal side of the pivot means, (c) a spring biasing the chopsticks to a spread apart position and allowing finger pivoting thereof toward a closed position so that the tongs may pick-up an edible, (d) retention means to releasably retain the chopsticks in said closed position, said retention means including a shallow protrusion on one handle and a shallow recess on the other handle to releasably receive the protrusion when the handles are closed together, said recess and protrusion having associated interengageable detent shoulders in spaced relation to the pivot means, said shoulders characterized as interfitting in such shallow and loose configuration as to be freed of interengagement in response to impact jarring of the closed together tongs, (e) the handles extending in overlapping relation in the direction of the pivot axis, as the handles pivot, the tong and handle of each chopstick having a juncture at which they extend in offset V-shaped configuration, in spaced relation to said pivot means, the closed together tongs having a rectangular outline, and the closed together handles having a rectangular outline, and (f) the spring being a torsion spring with arms extending in recesses defined by the handles proximate said pivot axis, said recesses and arms therein extending in the elongation direction of the chopsticks, (g) the tongs defining a common plane, normal to said axis, and the chopsticks interfitting in said closed position, with the handles extending in face to face relation in a first direction parallel to said axis, and the tongs extending in face to face relation in a second direction normal to said first direction.

* * * * *